US008830796B2

(12) United States Patent
Suzusho et al.

(10) Patent No.: US 8,830,796 B2
(45) Date of Patent: Sep. 9, 2014

(54) INFORMATION PROCESSING APPARATUS, INFORMATION TO BE BROWSED REGISTRATION METHOD, AND RECORDING MEDIUM

(75) Inventors: Takuya Suzusho, Tokyo (JP); Teppei Tsuchida, Tokyo (JP); Fumitake Yoshikawa, Tokyo (JP); Hiromi Nose, Tokyo (JP)

(73) Assignee: NEC Biglobe, Ltd., Tokyo (JP)

( * ) Notice: Subject to any disclaimer, the term of this patent is extended or adjusted under 35 U.S.C. 154(b) by 480 days.

(21) Appl. No.: 13/137,056

(22) Filed: Jul. 18, 2011

(65) Prior Publication Data

US 2012/0020190 A1 Jan. 26, 2012

(30) Foreign Application Priority Data

Jul. 21, 2010 (JP) ..... 2010-163962

(51) Int. Cl.
*G04G 13/02* (2006.01)
*G04B 47/00* (2006.01)
*G04C 21/36* (2006.01)

(52) U.S. Cl.
CPC ..... *G04G 13/025* (2013.01); *G04C 21/36* (2013.01)
USPC ..... 368/10; 368/13; 368/73; 368/250; 368/263

(58) Field of Classification Search
USPC ..... 368/73, 74, 250, 262–263, 10, 13; 340/309.16, 309.7–309.9; 455/556.1, 455/556.2
See application file for complete search history.

(56) References Cited

U.S. PATENT DOCUMENTS

| | | | | |
|---|---|---|---|---|
| 4,020,624 | A * | 5/1977 | Steinle et al. | 368/181 |
| 5,966,346 | A * | 10/1999 | Arai | 368/263 |
| 5,995,455 | A * | 11/1999 | Kutosky | 368/73 |
| 7,271,705 | B2 * | 9/2007 | Chon et al. | 340/309.16 |
| 2003/0142591 | A1 * | 7/2003 | Baweja et al. | 368/263 |
| 2003/0233250 | A1 * | 12/2003 | Joffe et al. | 705/2 |
| 2005/0010435 | A1 * | 1/2005 | Kato et al. | 705/2 |
| 2005/0237862 | A1 * | 10/2005 | Choi | 368/250 |

FOREIGN PATENT DOCUMENTS

| | | |
|---|---|---|
| JP | 2000-241573 A | 9/2000 |
| JP | 2002-149830 A | 5/2002 |

(Continued)

OTHER PUBLICATIONS

Japanese Office Action dated May 15, 2012, with partial English translation.

*Primary Examiner* — Vit W Miska
(74) *Attorney, Agent, or Firm* — McGinn I.P. Law Group, PLLC

(57) ABSTRACT

An information processing apparatus includes: a snooze button; an alarm stop button; an alarm processing unit that outputs the alarm at alarm time to be scheduled get-up time, resumes the alarm when manipulating the snooze button during the alarm after suspending the alarm for a predetermined period, stops the alarm when manipulating the alarm stop button during the alarm, and stops, when manipulating the alarm stop button during the suspension of the alarm, resuming the alarm after suspending the alarm; a computing unit that calculates, when stopping the alarm or stopping resumption of the alarm at the alarm processing unit, a get-up index based on the number of times to manipulate the snooze button from the start of the alarm to the manipulation of the alarm stop button; and a registration unit that registers the get-up index as the information to be browsed in the server.

18 Claims, 4 Drawing Sheets

(56) References Cited

FOREIGN PATENT DOCUMENTS

| | | | |
|---|---|---|---|
| JP | 2004-151037 | A | 5/2004 |
| JP | 2005-69793 | A | 3/2005 |
| JP | 2008-215992 | A | 9/2008 |
| JP | 2009-282867 | A | 12/2009 |

* cited by examiner

INFORMATION PROCESSING APPARATUS, INFORMATION TO BE BROWSED REGISTRATION METHOD, AND RECORDING MEDIUM

This application is based upon and claims the benefit of priority from Japanese patent application No. 2010-163962, filed on Jul. 21, 2010 the disclosure of which is incorporated herein in its entirety by reference.

BACKGROUND OF THE INVENTION

1. Field of the Invention

The present invention relates to an information processing apparatus, information to be browsed registration method, and recording medium, and more particularly to an information processing apparatus, information to be browsed registration method, and recording medium that have an alarm function.

2. Description of the Related Art

JP2008-215992A describes a cellular telephone having an alarm function with a snooze. The user of the cellular telephone described in JP2008-215992A can prevent a person from falling asleep again after getting up to turn off the alarm through the use of a snooze function.

The cellular telephone described in JP2008-215992A simply rings the alarm, having no mechanism that improves motivation of the user to get up at the scheduled time. For this reason, the cellular telephone described in JP2008-215992A has a problem of a poor function in that the user is prevented from going to sleep again.

SUMMARY OF THE INVENTION

It is an exemplary object of the present invention to provide an information processing apparatus, information to be browsed registration method, and recording medium that can solve the aforementioned problem.

An information processing apparatus according to an exemplary aspect of the invention, which communicates with a server that allows an external device to browse information to be browsed, includes:

a snooze button;

an alarm stop button;

an alarm processing unit configured to:

output an alarm at scheduled get-up time;

perform, when manipulating the snooze button while the alarm is being sounded, a snooze operation in which the alarm is resumed after suspending the alarm for a predetermined time period;

stop the alarm when manipulating the alarm stop button while the alarm is being sounded; and stop the resumption of the alarm after suspending the alarm when manipulating the alarm stop button during the suspension of the alarm;

a computing unit configured to calculate, when stopping the alarm or stopping the resumption of the alarm at the alarm processing unit, a get-up index that expresses a degree that indicates an amount of time that a user takes to get up based on the number of times to manipulate the snooze button from a point in time when starting the alarm at the alarm time to a point in time when manipulating the alarm stop button; and a registration unit configured to register, in the server, the get-tip index calculated at the computing unit as the information to be browsed.

An method for registering information to be browsed according to an exemplary aspect of the invention in an information processing apparatus, which communicates with a server that allows an external device to browse for information to be browsed and having a snooze button and an alarm stop button, includes:

performing an alarm process including:

outputting an alarm at alarm time that is set as scheduled get-up time;

performing, when manipulating the snooze button while the alarm is being sounded, a snooze operation in which the alarm is resumed after suspending the alarm for a predetermined time period;

stopping the alarm when manipulating the alarm stop button while the alarm is being sounded; and stopping the resumption of the alarm after suspending the alarm when manipulating the alarm stop button during the suspension of the alarm;

calculating, when stopping the alarm or stopping the resumption of the alarm, a get-up index that expresses a degree that indicates an amount of time that a user takes to get up based on the number of times to manipulate the snooze button from a point in time when starting the alarm at the alarm time to a point in time when manipulating the alarm stop button; and registering the get-up index as the information to be browsed in the server.

A computer readable recording medium according to an exemplary aspect of the invention has thereon a program that enables a computer to operate the information processing apparatus according to the information to be browsed registration method.

The above and other objects, features, and advantages of the present invention will become apparent from the following description with reference to the accompanying drawings which illustrate an example of the present invention.

DETAILED DESCRIPTION of EXEMPLARY EMBODIMENT

In the following, an exemplary embodiment of the present invention will be described with reference to the drawings.

Figure 1:
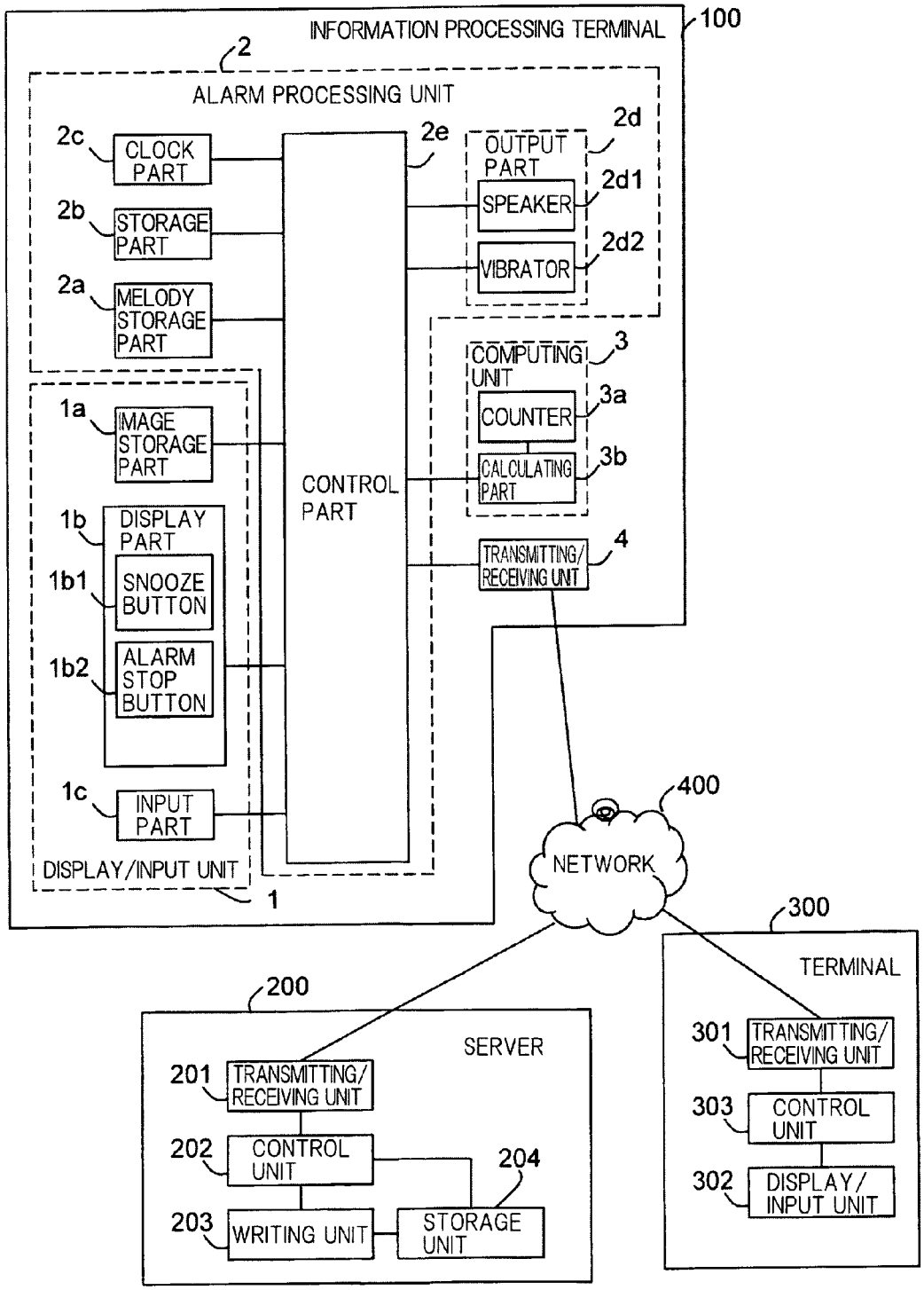
FIG. 1 is a block diagram depicting a get-up state management system including information processing terminal 100 according to an embodiment of the present invention.

FIG. 1 is a block diagram depicting a get-up state management system including information processing terminal 100 according to an exemplary embodiment of the present invention. In FIG. 1, the get-up state management system includes information processing terminal 100, server 200, and terminal 300. In addition, the number of terminal 300 is not limited to a single terminal, but may be multiple terminals. Information processing terminal 100, server 200, and terminal 300 can communicate with each other via network 400.

Information processing terminal 100 can be generally called an information processing apparatus. Information processing terminal 100 is a cellular telephone such as a smartphone, for example. In addition, information processing terminal 100 is not limited to a cellular telephone, but may be a PC (Personal Computer), for example, and can be freely changed.

Information processing terminal 100 can communicate with server 200 that allows terminal 300 to browse for information to be browsed. Information processing terminal 100 includes display/input unit 1, alarm processing unit 2, computing unit 3, and transmitting/receiving unit 4.

Display/input unit 1 includes image storage part 1*a*, display part 1*b*, and input part 1*c*. Alarm processing unit 2 includes melody storage part 2*a* that stores therein items of information about a plurality of melodies selectable as alarm sounds, storage part 2*b*, clock part 2*c*, output part 2*d*, and control part 2*e*. Output part 2*d* includes speaker 2*d*1 and vibrator 2*d*2. Computing unit 3 includes counter 3*a* and calculating part 3*b*.

Display/input unit 1 displays images and accepts information inputted by a user.

Image storage part 1*a* stores items of image information about images to be displayed on display part 1*b*, such as alarm setting screen information representing an alarm setting screen, image information representing a snooze button, and image information representing an alarm stop button.

In addition, image storage part 1*a* stores a pair of two preset items of image information (in the following, one of the two preset items of image information is referred to as "first image information" and the other is referred to as "second image information").

In this embodiment, in the paired first image information and second image information, the first image information represents an image in which a part of this image is hidden (in the following, referred to as "a first image"), and the second image information represents an image that at least shows the part hidden in the first image (in the following, referred to as "a second image"). For example, in the case where the first image represents a person whose face is covered with his/her hands, the second image is an image that at least shows the face hidden in the first image.

Display part 1*b* displays the alarm setting screen according to the alarm setting screen information. The alarm setting screen is a screen that sets alarm time, an alarm volume, a result of melody selection in which a melody to be used as an alarm is selected from a plurality of melodies identified by information in melody storage part 2*a*, a day of the week on which the alarm is activated (in the following, referred to as "a day of the week for the alarm"), the presence or absence of a vibration operation for the alarm, and a time interval between snoozes (in the following, referred to as "a snooze interval"). In addition, the snooze interval can be generally called a predetermined time period.

Display part 1*b* displays snooze button 1*b*1 according to the image information representing the snooze button. Moreover, display part 1*b* displays alarm stop button 1*b*2 according to the image information representing the alarm stop button.

Furthermore, display part 1*b* displays the first image according to the first image information, and the second image according to the second image information. In addition, display part 1*b* alternatively displays the first and second image.

Input part 1*c* is a touch panel, for example, and is provided on the front surface of display part 1*b*. Input part 1*c* accepts a user input. Input part 1*c* accepts the individual items of information that the user inputs according to the alarm setting screen, for example, (the alarm time that is set for scheduled get-up time, the alarm volume, the result of melody selection, the day of the week for the alarm, the presence or absence of the vibration operation, and the snooze interval).

Moreover, input part 1*c* is not limited to a touch panel, which may be a key button. In the case where input part 1*c* is a key button, input part 1*c* is provided on the front surface of information processing terminal 100, not on the front surface of display part 1*b*. Furthermore, input part 1*c* may have both snooze button 1*b*1 and alarm stop button 1*b*2.

Alarm processing unit 2 can be generally called alarm process means.

Alarm processing unit 2 outputs an alarm at the alarm time accepted at input part 1*c*.

Moreover, when snooze button 1*b*1 is manipulated while the alarm is being sounded, alarm processing unit 2 performs a snooze operation in which the alarm is resumed after suspending the alarm for the snooze interval accepted at input part 1*c* (for example, for ten minutes). Furthermore, the snooze interval is not limited to ten minutes, but may be one minute, for example, and can be freely changed.

In addition, when alarm stop button 1*b*2 is manipulated while the alarm is being sounded, alarm processing unit 2 stops alarm.

Moreover, when alarm stop button 1*b*2 is manipulated during the suspension of the alarm, alarm processing unit 2 ends the snooze operation, and stops the resumption of the alarm after suspending the alarm.

As described above, melody storage part 2*a* stores items of information about a plurality of melodies that are selectable as alarm sounds.

Storage part 2*b* stores the individual items of information that the user inputs at input part 1*c* according to the alarm setting screen (the alarm time, the alarm volume, the result of melody selection, the day of the week for the alarm, the presence or absence of the vibration operation, and the snooze interval).

Storage part 2*b* also stores snooze maximum count information that represents the preset maximum number of times that the snooze operation is repeated. Moreover, storage part 2*b* may store snooze maximum count information accepted at input part 1*c*. The snooze maximum count information accepted at input part 1*c* can represent a given number of times as the maximum number of times that the snooze operation is to be repeated.

Furthermore, storage part 2*b* also stores items of information representing connection information that is necessary to connect to server 200, a comment that the user gets up, and a comment that the user goes to bed. The connection information at least represents an ID that identifies the user of information processing terminal 100, and also represents a password if necessary.

Clock part 2*c* outputs time information that represents the time of day. In this embodiment, clock part 2*c* outputs time information that represents the present time of day, and day-of-week information that represents the present day of the week. In addition, clock part 2*c* may not be included in alarm processing unit 2. In this case, for example, a clock unit that information processing terminal 100 includes in advance is used for clock part 2*c*. Clock part 2*c* is located at the outside of alarm processing unit 2, and alarm processing unit 2 includes melody storage part 2*a*, storage part 2*b*, output part 2*d*, and control part 2*e*.

Output part 2*d* has speaker 2*d*1 and vibrator 2*d*2, and outputs an alarm.

When the time of day indicated by time information from clock part 2*c* reaches the alarm time represented by information in storage part 2*b*, control part 2*e* outputs a melody indicated by the result of melody selection that is represented by information in storage part 2*b* from a plurality of melodies represented by information in melody storage part 2*a* from speaker 2*d*1 at the alarm volume indicated by information in storage part 2*b*.

In this embodiment, when the time of day indicated by time information reaches the alarm time and a day of the week indicated by day-of-week information from clock part 2*c* reaches the day of the week for the alarm indicated by information in storage part 2*b*, control part 2*e* outputs the melody indicated by the result of melody selection from speaker 2*d*1 at the alarm volume indicated by information in storage part 2*b*.

In addition, in the following, for simplifying the explanation, the day of the week for the alarm indicated by information in storage part 2*b* represents all the days of the week. In this case, control part 2*e* is to output an alarm from speaker 2*d*1 when the time of day indicated by time information reaches the alarm time.

Moreover, in the case where storage part 2*b* stores information indicating the presence of the vibration operation, control part 2*e* operates vibrator 2*d*2 while the alarm is being sounded from speaker 2*d*1. Thus, the operation of vibrator 2*d*2 also functions as an alarm. On the other hand, in the case where storage part 2*b* stores information indicating the absence of the vibration operation, control part 2*e* does not operate vibrator 2*d*2 even though an alarm is outputted from speaker 2*d*1.

Furthermore, when snooze button 1*b*1 is manipulated while the alarm is being sounded, control part 2*e* performs the snooze operation in which the alarm is resumed after activation of the alarm was suspended output part 2*d* for the snooze interval indicated by information in storage part 2*b*.

In addition, when alarm stop button 1*b*2 is manipulated while the alarm is being sounded, control part 2*e* stops the alarm from being activated by output part 2*d*. Moreover, when alarm stop button 1*b*2 is manipulated during the suspension of the alarm in association with the snooze operation, control part 2*e* ends the snooze operation, and stops the resumption of the alarm after suspending the alarm.

Computing unit 3 can be generally called calculating means.

When the alarm is stopped or resumption of the alarm is stopped at alarm processing unit 2, computing unit 3 calculates "an immediate get-up index" that expresses the degree that indicates the amount of time that a user takes to get up based on the number of times to manipulate the snooze button from the point in time when the alarm is started at the alarm time to the point in time when alarm stop button 1*b*2 is manipulated. The immediate get-up index can be generally called a get-up index. In this embodiment, the immediate get-up index expresses the degree that indicates the amount of time that it takes a user to immediately get up.

Counter 3*a* is used for counting the number of times to manipulate snooze button 1*b*1 (snooze count) from the point in time when the alarm is started at the alarm time to the point in time when alarm stop button 1*b*2 is manipulated.

Calculating part 3*b* counts a number with counter 3*a* each time when the alarm is suspended according to the manipulation of snooze button 1*b*1. In addition, the initial value of counter 3*a* is set to "zero".

Calculating part 3*b* calculates the immediate get-up index based on the count value of counter 3*a* when the alarm is stopped or when resumption of the alarm is stopped at alarm processing unit 2.

In this embodiment, calculating part 3*b* reduces the value expressed by the immediate get-up index as the number of times to manipulate snooze button 1*b*1 becomes greater from the start of the alarm to the manipulation of alarm stop button 1*b*2.

For example, calculating part 3*b* calculates the immediate get-up index according to an arithmetic expression below where the number of times to continuously repeat snoozes is set to five.

$$\text{Immediate get-up index} = 100 - (12 \times \text{snooze count})$$

The arithmetic expression of the immediate get-up index is not limited to the foregoing arithmetic expression, which can be freely changed.

In addition, in a situation in which the number of times to continuously repeat snooze operations is set to nine or more, the immediate get-up index calculated according to the foregoing arithmetic expression is sometimes "zero" or less. In this embodiment, in the case where the immediate get-up index is "zero" or less, calculating part 3*b* sets the immediate get-up index to "zero".

After calculating the immediate get-up index, calculating part 3*b* resets the count value of counter 3*a* to the initial value "zero".

Transmitting/receiving unit 4 can be generally called registering means.

Transmitting/receiving unit 4 registers the immediate get-up index calculated at computing unit 3 in server 200 as information to be browsed.

In this embodiment, transmitting/receiving unit 4 sends a get-up message including connection information (an ID, and a password if necessary) and the comment that the user gets up in storage part 2*b*, and the immediate get-up index calculated at calculating part 3*b* as information to be browsed to server 200 via network 400, and registers in server 200 the comment that the user gets up and the immediate get-up index as an ID message (information to be browsed) in the get-up message.

Moreover, transmitting/receiving unit 4 sends a browse request for information to be browsed in server 200 to server 200 according to the user input accepted at input part 1*c*.

Furthermore, transmitting/receiving unit 4 receives the information to be browsed sent from server 200 in response to the browse request. Control part 2*e* displays the information to be browsed received at transmitting/receiving unit 4 on display part 1*b*.

In addition, when the time of day indicated by time information from clock part 2*c* reaches the alarm time represented by information in storage part 2*b*, control part 2*e* displays the first image represented by the first image information in image storage part 1*a*, snooze button 1*b*1, and alarm stop button 1*b*2 on display part 1*b*.

Moreover, control part 2*e* reduces the size of the first image displayed on display part 1*b* every time when snooze button 1*b*1 is manipulated while the alarm is being sounded.

Furthermore, control part 2*e* further displays on display part lb a snooze count corresponding image in which the form is changed based on the value in which the actual number of times that the snooze operation is continuously repeated (a count value of counter 3*a*) is subtracted from the maximum number of times that the snooze operation is continuously repeated.

For the snooze count corresponding image, such an image, for example, may be used in which blocks are stacked, in which the number of the blocks is the number in which the count value of counter 3*a* is subtracted from the maximum number of times to continuously repeat snooze operations. In addition, the snooze count corresponding image is not limited to the image in which the blocks are stacked, in which the number of the blocks is the number that is generated by subtracting the count value of counter from the maximum number of times that the snooze operations is continuously repeated, which can be freely changed.

Moreover, control part 2*e* displays the first image from the start of the output of the alarm at the alarm time to the manipulation of alarm stop button 1*b*2, and displays the second image instead of the first image after alarm stop button 1*b*2 is manipulated. In addition, the first image is the image of a person whose face is covered with his/her hands, for example, and the second image is the image of the face hidden in the first image.

Furthermore, it is also possible that when alarm processing unit 2 is activated, control part 2*e* sends a go-to-bed message including connection information and the comment that the user goes to bed in storage part 2*b* as information to be browsed to server 200 via network 400 and registers the comment that the user goes to bed as an ID message (information to be browsed) in the go-to-bed message in server 200.

It is also possible to implement information processing terminal 100 with a computer. In this case, the computer functions as display/input unit 1, alarm processing unit 2, computing unit 3, and transmitting/receiving unit 4 by performing a program that has been accepted through a cable or wireless communication line.

In addition, the computer that implements information processing terminal 100 may function as display/input unit 1, alarm processing unit 2, computing unit 3, and transmitting/receiving unit 4 by reading and executing a program recorded on a recording medium like a computer ratable CD-ROM (Compact Disk Read Only Memory). The recording medium is not limited to a CD-ROM, but can be freely changed.

Server 200 includes transmitting/receiving unit 201, control unit 202, writing unit 203, and storage unit 204.

Transmitting/receiving unit 201 sends and receives information with information processing terminal 100 and terminal 300.

When transmitting/receiving unit 201 receives a get-up message, for example, from information processing terminal 100, control unit 202 outputs the get-up message to writing unit 203.

In addition, when transmitting/receiving unit 201 receives a go-to-bed message from information processing terminal 100, control unit 202 outputs the go-to-bed message to writing unit 203.

When writing unit 203 accepts the get-up message, it writes the comment that the user gets up and the immediate get-up index as the ID message included in the get-up message on a page (information to be browsed) such as a home page, blog, or bulletin board system as well as the received time of the get-up message, and stores the written result (information to be browsed) in storage unit 204.

Moreover, when writing unit 203 accepts the go-to-bed message, it writes the comment that the user goes to bed as the ID message included in the go-to-bed message on a page such as the page of a home page, blog, or bulletin board system as well as the received time of the go-to-bed message, and stores the written result in storage unit 204.

In addition, when transmitting/receiving unit, 201 receives a browse request, control unit 202 sends a page that is requested for a browse by the browse request to the source of the browse request.

Terminal 300 can be generally called an external device.

Terminal 300 includes transmitting/receiving unit 301, display/input unit 302, and control unit 303.

Transmitting/receiving unit 301 sends and receives information with information processing terminal 100 and server 200. Display/input unit 302 includes a display unit and an input unit for displaying images and accepting information inputted by the user.

When display/input unit 302 accepts a browse request, control unit 303 sends the browse request from transmitting/receiving unit 301 to server 200. When transmitting/receiving unit 301 receives a page corresponding to the browse request, control unit 303 displays the page on display/input unit 303. When display/input unit 302 accepts a reply message to the page corresponding to the browse request, control unit 303 sends the reply message to server 200.

In server 200, when transmitting/receiving unit 201 receives the reply message, control unit 202 outputs the reply message to writing unit 203., When writing unit 203 accepts the reply message, it writes a comment described in the reply message in the page that is the source of the reply message, and stores the written result (information to be browsed) in storage unit 204.

In addition, it is possible that information processing terminal 100 also displays the page on which the reply message is written, the page being sent from another terminal (terminal 300), by sending a browse request to server 200.

Next, the operation will be described.

Figure 2:
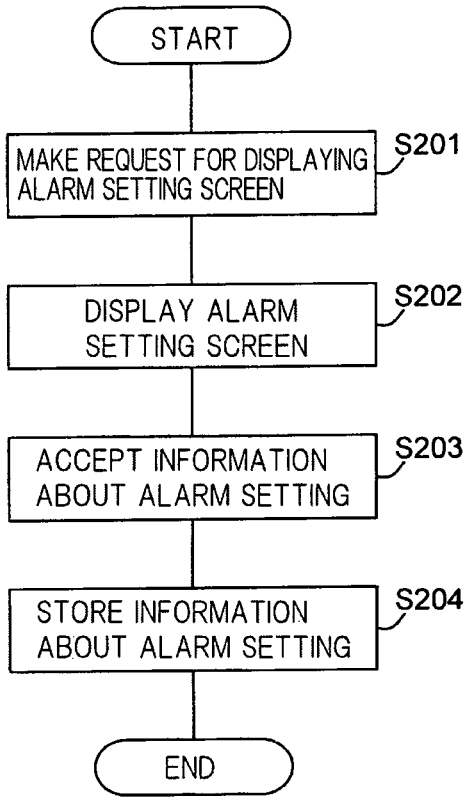
FIG. 2 is a diagram illustrative of an alarm setting operation using an alarm setting screen.

FIG. 2 is a diagram illustrative of an alarm setting operation according to the alarm setting screen.

When input part 1*c* accepts a display request for the alarm setting screen from the user (Step S201), control part 2*e* displays the alarm setting screen on display part 1*b* according to the alarm setting screen information in image storage part 1*a* (Step S202).

When input part 1*c* accepts the individual items of information (the alarm time, the alarm volume, the result of melody selection, the day of the week for the alarm, the presence or absence of the vibration operation, and the snooze interval), which are inputted by the user according to the alarm setting screen, (Step S203), control part 2*e* stores the individual items of information accepted at input part 1*c* in storage part 2*b* (Step S204).

Figure 3:
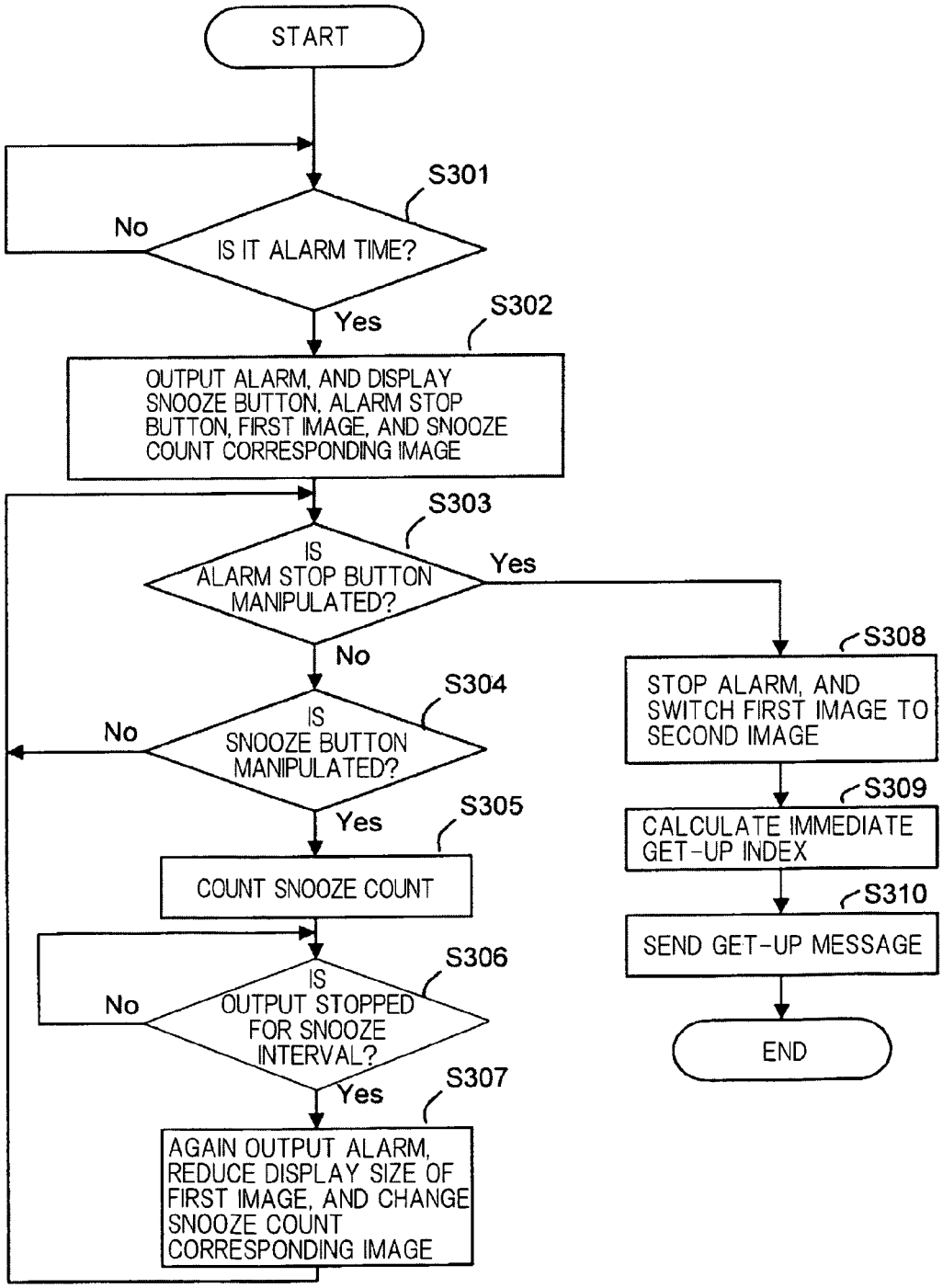
FIG. 3 is a diagram illustrative of the operation relating to implementing an alarm.

FIG. 3 is a diagram illustrative of the operation relating to implementing the alarm. Suppose that the case shown in FIG. 3 shows that the day of the week for the alarm indicated by information in storage part 2*b* also represents all the days of the week. When the time of day indicated by time information from clock part 2*c* reaches the alarm time (Step S301), output part 2*d* outputs an alarm, and display part 1*b* displays snooze button 1*b*1, alarm stop button 1*b*2, the first image, and the snooze count corresponding image (Step S302).

In addition, the first image is the image of a person whose face is covered with his/her hands, for example, and the snooze count corresponding image is the image in which blocks are stacked, in which the number of the blocks is the number that is generated by subtracting the count value of counter 3*a* from the maximum number of times that the snooze operation is continuously repeated, for example.

When snooze button 1*b*1 is manipulated while the alarm is being sounded (Steps S303 and S304), calculating part 3*b* increments counter 3*a* (Step S305), and output part 2*d* suspends the output of the alarm for the snooze interval (Step S306).

When the alarm is suspended for the snooze interval, output part 2*d* resumes the alarm, and display part 1*b* reduces and displays the first image by a predetermined percentage of reduction (for example, the percentage of reduction is 90% when the number of times to manipulate snooze button 1*b*1 is one, 80% when two, and so on; the percentage of reduction is reduced by 10% each as the number of times of manipulation is increased), and changes the display form of the snooze count corresponding image according to the count value of counter 3*a* (Step S307). At this time, display part 1*b* does not change the size of snooze button 1*b*1 and alarm stop button 1*b*2.

Figure 4:
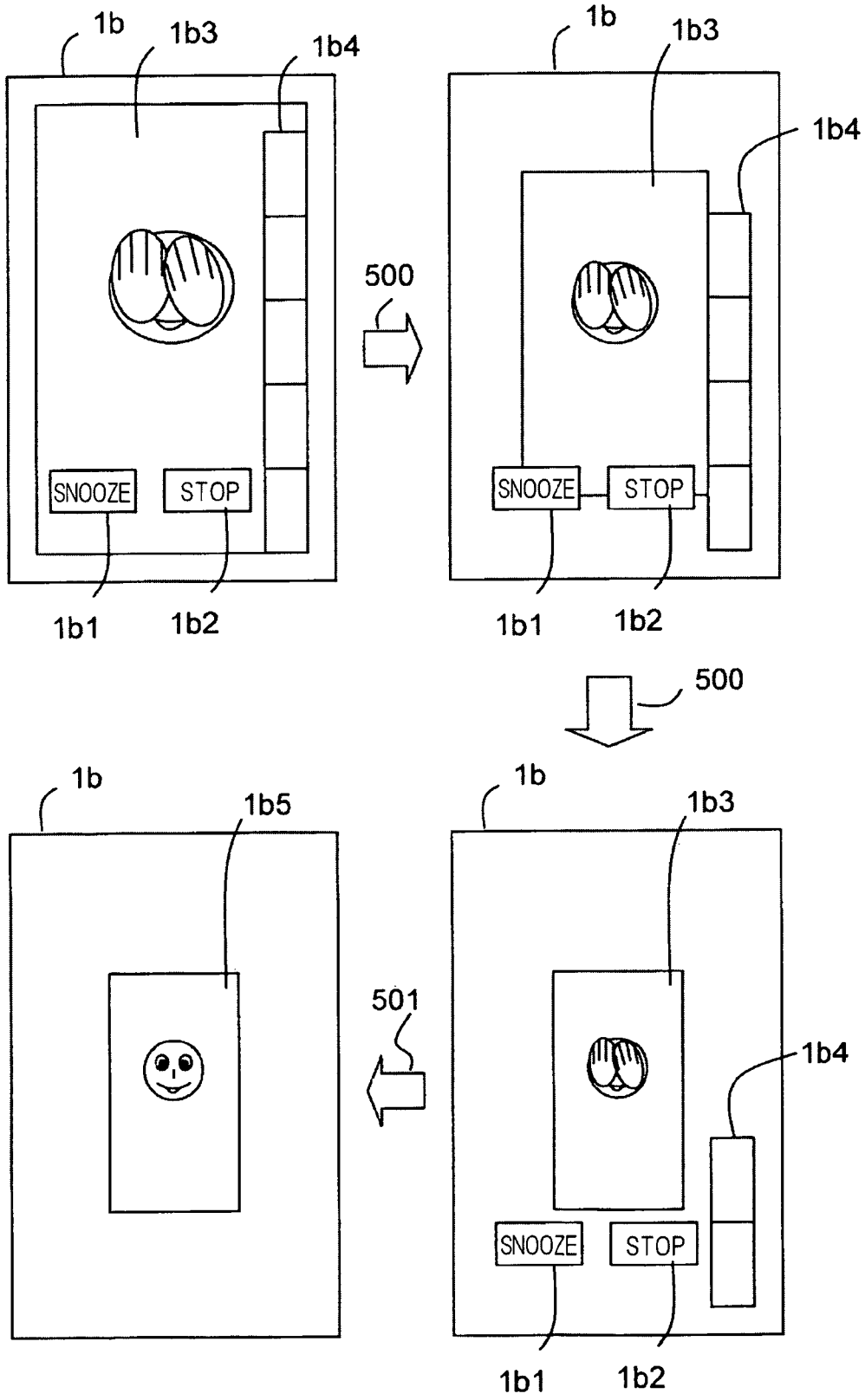
FIG. 4 is a diagram depicting images on display part 1*b*, in which the images change in accordance with an increase in the number of times that snooze button 1*b*1 is manipulated.

FIG. 4 is a diagram depicting exemplary images on display part 1*b*, in which the images change in accordance with an increase in the number of times that snooze button 1*b*1 is manipulated.

In FIG. 4, snooze button 1*b*1, alarm stop button 1*b*2, first image 1*b*3, and snooze count corresponding image 1*b*4 are displayed on display part 1*b*. As shown in FIG. 4, on display part 1*b*, the image is changed as indicated by arrow 500 in accordance with an increase in the number of times that snooze button 1*b*1 is manipulated.

In addition, during the suspension of the alarm, display part 1*b* may or may not individually display snooze button 1*b*1, alarm stop button 1*b*2, first image 1*b*3, and snooze count corresponding image 1*b*4.

Next, the process returns to Step S303.

In Step S303, when alarm stop button 1*b*2 is manipulated, output part 2*d* stops the alarm to reset the alarm, and display part 1*b* displays second image 1*b*5 at the same percentage of reduction as that of first image 1*b*3 that is being displayed at present, instead of first image 1*b*3 as indicated by arrow 501 in FIG. 4 (Step S308). Second image 1*b*5 is the image that at least shows the face hidden in the first image, for example. Moreover, in FIG. 4, snooze count corresponding image 1*b*4 is not displayed as indicated by arrow 501, when alarm stop button 1*b*2 is manipulated. However, snooze count corresponding image 1*b*4 may be continuously displayed for a certain time period (one minute, for example) after alarm stop button 1*b*2 is manipulated, for example. Furthermore, a certain time period is not limited to one minute, but can be freely changed.

In addition, in the case where alarm stop button 1*b*2 is manipulated in the situation in which the snooze operation suspends the alarm, control part 2*e* performs an interruption process to stop the resumption of the alarm, and advances the process to Step S308.

After Step S308 is finished, calculating part 3*b* calculates an immediate get-up index using the count value of counter 3*a* and the predetermined arithmetic expression (Step S309).

Subsequently, transmitting/receiving unit 4 sends a get-up message including connection information and the comment that the user gets up in storage part 2*b* and the immediate get-up index calculated at calculating part 3*b* as information to be browsed to server 200 via network 400, so that it registers in server 200 the comment that the user gets up and the immediate get-up index as an ID message (information to be browsed) in the get-up message (Step S310).

In server 200, when transmitting/receiving unit 201 receives the get-up message from information processing terminal 100, control unit 202 outputs the get-up message to writing unit 203.

When writing unit 203 accepts the get-up message, it writes the comment that the user gets up and the immediate get-up index as the ID message included in the get-up message on a page such as the page of a home page, blog, or bulletin board system, and stores the written result in storage unit 204.

Moreover, when transmitting/receiving unit 201 receives a browse request, control unit 202 sends a page, for which a request has been made by the browse request to perform browsing, to the source of the browse request.

Furthermore, when transmitting/receiving unit 201 receives a reply message concerning the page for which a request has been made to perform browsing, control unit 202 outputs the reply message to writing unit 203.

When writing unit 203 accepts the reply message, it writes a comment described in the reply message on a page that is the source of the reply message (information to be browsed), and stores the written result (information to be browsed) in storage unit 204.

It is possible that information processing terminal 100 also displays the page on which the reply message is written, the page being sent from another terminal (terminal 300), by sending a browse request to server 200.

Moreover, in the foregoing embodiment, it is also possible that image storage part 1*a* stores a plurality of pairs of first image information and second image information and changes the pair to be used at display part 1*b* in units of days.

In addition, in the case where the user can set the maximum number of times to continuously repeat snooze operations, it is also possible that the operation relating to snooze control is automatically ended after the actual number of times to perform the snooze operation reaches the maximum number of times to continuously repeat snooze operations.

Moreover, it is also possible that transmitting/receiving unit 4 adds the URL of a program providing device, which can provide a program that enables the computer to function as information processing terminal 100, to the get-up message and the go to bed message. Furthermore, it is also possible that transmitting/receiving unit 4 adds the URL of a program providing device, which can provide a program that enables the computer to function as information processing terminal 100 and a comment that introduces the program, to the get-up message and the go-to-bed message.

In addition, it is also possible that a terminal having the same configuration as that of information processing terminal 100 is used for terminal 300.

According to the embodiment, when the alarm is stopped or the resumption of the alarm is stopped at alarm processing unit 2, computing unit 3 calculates the immediate get-up index based on the number of times to manipulate snooze button 1*b*1 from the point in time when the alarm is started at the alarm time to the point in time when alarm stop button 1*b*2 is manipulated.

Transmitting/receiving unit 4 registers the immediate get-up index calculated at computing unit 3 in server 200 as information to be browsed.

Thus, "the immediate get-up index" that expresses the degree that indicates the amount of time that it takes a user get up is open to the public through server 200. Accordingly, it becomes possible that third parties browse the degree that indicates the amount of time that it takes a user to get up through server 200, and it becomes possible that the user's motivation to get up at the scheduled time is improved. Moreover, it becomes possible to support communications concerning the time period that the user takes to get up through server 200.

In addition, in this embodiment, computing unit 3 reduces the value expressed by "the immediate get-up index" as the number of times to manipulate snooze button 1*b*1 becomes greater from the start of the alarm to the manipulation of alarm stop button 1*b*2. In this case, it is possible to increase the value of "the immediate get-up index" as the time period that the user takes to get up becomes shorter.

In addition, in this embodiment, alarm processing unit 2 reduces the size of the first image displayed on display part 1*b* and the second image displayed after the first image each time when snooze button 1*b*1 is manipulated while the alarm is being sounded. In this case, if images that the user prefers are used for the first and second image, the percentage of reduction of the size of the first and second image is not decreased as the time period that the user takes to get up becomes shorter. Thus, it becomes possible to improve motivation of the user to get up at the scheduled time.

In addition, in this embodiment, display part 1*b* further displays the snooze count corresponding image in which the form is changed based on the value in which the number of times that the snooze operation is continuously repeated is subtracted from the preset number of times (the maximum number of times that the snooze operation is continuously repeated). In this case, it becomes possible that the user knows the remaining number of times of the snooze operation by confirming the form of the snooze count corresponding image.

In addition, in the case where transmitting/receiving unit 4 registers the go-to-bed message as information to be browsed in server 200 when alarm processing unit 2 is activated, information about the user going to bed is also open to the public as well as "the immediate get-up index" that expresses the degree that indicates the amount of time that it takes a user to get up through server 200. Thus, it becomes possible to support communications concerning the time period that the user takes to go to bed and to get up through server 200.

In the foregoing embodiment, the illustrated configurations are only examples, and the present invention is not limited to these configurations.

An exemplary effect of the present invention is to make possible an improvement in the motivation of the user to get up at the scheduled time.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims

What is claimed is:

1. An information processing apparatus communicating with a server that allows browsing for information to be browsed, the information to be browsed being transmitted from each external device of at least one third party, the apparatus comprising:

a snooze button;

an alarm stop button;

an alarm processing unit configured to:

output an alarm at an alarm time at which a user is scheduled to get-up;

perform, when manipulating the snooze button while the alarm is being sounded, a snooze operation in which the alarm is resumed after suspending the alarm for a predetermined time period;

stop the alarm when manipulating the alarm stop button while the alarm is being sounded; and stop a resumption of the alarm after suspending the alarm when manipulating the alarm stop button during the suspension of the alarm;

a computing unit configured to calculate, when stopping the alarm or stopping resumption of the alarm at the alarm processing unit, a get-up index that expresses a degree that indicates an amount of time that it takes a user to get up based on a number of times to manipulate the snooze button from a point in time when starting the alarm at the alarm time to a point in time when manipulating the alarm stop button; and a registration unit configured to register as the information to be browsed, in the server, both a comment about getting up and the get-up index calculated at the computing unit.

2. The information processing apparatus according to claim 1, wherein the computing unit reduces a value represented by the get-up index as the number of times that the snooze button is manipulated becomes greater from a point at which the alarm is started to a point at which the alarm stop button is manipulated.

3. The information processing apparatus according to claim 1, further comprising:

a storage unit configured to store a first image and a second image, the second image at least showing a part hidden in the first image, and a display unit configured to display the first image or the second image, wherein the alarm processing unit displays the first image on the display unit at the alarm time and displays the first image on the display unit in a reduced size according to a predetermined percentage for size reduction each time that the snooze button is manipulated while the alarm is being sounded, and wherein the alarm processing unit displays, on the display unit, the second image at a same percentage of reduction as the percentage of reduction of the first image that is being displayed, instead of the first image when manipulating the alarm stop button.

4. The information processing apparatus according to claim 3, wherein:

the alarm processing unit continuously repeats the snooze operation at a predetermined number of times; and the display unit further displays a snooze count corresponding image in which a form is changed based on a value in which the number of times that the snooze operation is continuously repeated is subtracted from the predetermined number.

5. The information processing apparatus according to claim 1, wherein the registration unit registers sleep start information indicating that the user is going to bed, as the information to be browsed in the server when activating the alarm processing unit.

6. The information processing apparatus according to claim 1, wherein, upon an occurrence of said manipulating the alarm stop button while the alarm is being sounded, said alarm processing unit displays a first image and a second image, the second image including a part hidden in the first image.

7. The information processing apparatus according to claim 1, wherein upon an occurrence of said manipulating the snooze button while the alarm is being sounded, said alarm processing unit displays a first image at a reduced size, and wherein said reduced size is less than a size of said first image when said first image is displayed during a previous occurrence said manipulating the snooze button while the alarm is being sounded.

8. The information processing apparatus according to claim 1, wherein said registration unit further registers, as the information to be browsed, a comment about going to sleep.

9. The information processing apparatus according to claim 3, wherein said storage unit further stores snooze maximum count information indicating a maximum number of times that the snooze operation may repeat.

10. The information processing apparatus according to claim 9, wherein said maximum number of times that the snooze operation may repeat is preset by said user, and wherein after said maximum number of times that the snooze operation may repeat is reached, said snooze operation is disabled.

11. The information processing apparatus according to claim 9, wherein said alarm processing unit displays a snooze count corresponding image, and wherein a form of said snooze count corresponding image is changed based on a number of times that said snooze operation is repeated.

12. An information to be browsed registration method in an information processing apparatus communicating with a server that allows browsing for information to be browsed, the information to be browsed being transmitted from each external device of one or more third parties, and comprising a snooze button and an alarm stop button, the method comprising:

performing an alarm process including:

outputting an alarm at alarm time that is set as scheduled get-up time;

performing, when manipulating the snooze button while the alarm is being sounded, a snooze operation in which the alarm is resumed after suspending the alarm for a predetermined time period;

stopping the alarm when manipulating the alarm stop button while the alarm is being sounded; and stopping the resumption of the alarm after suspending the alarm when manipulating the alarm stop button during the suspension of the alarm;

calculating, when stopping the alarm or stopping resumption of the alarm, a get-up index that expresses a degree that indicates an amount of time that it takes a user to get up based on a number of times that the snooze button is manipulated from a point in time when the alarm is started at the alarm time to a point in time when the alarm stop button is manipulated; and registering both a comment about getting up and the get-up index as the information to be browsed in the server.

13. The information to be browsed registration method according to claim 12, wherein the calculating includes reducing a value represented by the get-up index as the number of times that the snooze button is manipulated becomes greater from a point at which the alarm is started to a point at which the alarm stop button is manipulated.

14. The information to be browsed registration method according to claim 12, further comprising:

storing a first image and a second image that at least shows a part hidden in the first image, in a storage unit;

displaying the first image on a display unit at the alarm time and displaying the first image on the display unit in a reduced size according to a predetermined percentage for size reduction each time that the snooze button is manipulated while the alarm is being sounded; and displaying the second image on the display unit at a same percentage of reduction as the percentage of reduction of the first image that is being displayed, instead of the first image when manipulating the alarm stop button.

15. The information to be browsed registration method according to claim 14, wherein:

the information processing apparatus continuously repeats the snooze operation for a predetermined number of times; and the method further includes displaying, on the display unit, a snooze count corresponding image in which a form is changed based on a value in which the number of times that the snooze operation is continuously repeated is subtracted from the predetermined number.

16. The information to be browsed registration method according to claim 12, wherein the registering registers sleep start information indicating that the user is going to bed, as the information to be browsed in the server when starting to activate the alarm.

17. A computer readable recording medium having thereon a program that enables a computer to operate the information processing apparatus in the information to be browsed registration method according to claim 12.

18. An information processing apparatus communicating with a server that allows browsing for information, the apparatus comprising:

a snooze button;

an alarm stop button;

an alarm processing unit which:

outputs an alarm at an alarm time at which a user is scheduled to get-up;

performs, when manipulating the snooze button while the alarm is being sounded, a snooze operation in which the alarm is resumed after suspending the alarm for a predetermined time period;

stops the alarm when manipulating the alarm stop button while the alarm is being sounded; and stops a resumption of the alarm after suspending the alarm when manipulating the alarm stop button during the suspension of the alarm;

a computing unit which calculates a get-up index upon an occurrence of one of stopping the alarm and stopping the resumption of the alarm; and a registration unit which registers, as said information, in the server, both a comment about getting up and the get-up index.

* * * * *